United States Patent [19]

Rautimo et al.

[11] 4,380,901

[45] Apr. 26, 1983

[54] HYDRAULIC PERCUSSION MACHINE

[75] Inventors: Pertti V. Rautimo, Lahti; Raimo Pelto-Huikko, Hki; Esko A. O. Åhlman, Kartano, all of Finland

[73] Assignee: Kone Oy, Helsinki, Finland

[21] Appl. No.: 163,794

[22] Filed: Jun. 27, 1980

[30] Foreign Application Priority Data

Jun. 29, 1979 [FI] Finland ..... 792066

[51] Int. Cl.[3] ..... F01B 25/04; F01L 25/04

[52] U.S. Cl. ..... 60/418; 91/165; 91/220; 91/300; 92/134

[58] Field of Search ..... 92/134; 91/166, 165, 91/220, 300; 60/418

[56] References Cited

U.S. PATENT DOCUMENTS

| | | | |
|---|---|---|---|
| 3,908,373 | 9/1975 | Peterson | 92/134 |
| 3,925,985 | 12/1975 | Peterson | 92/134 |
| 4,103,591 | 8/1978 | Reiersdol | 92/134 |
| 4,230,019 | 10/1980 | Caston | 91/220 |

*Primary Examiner*—Paul E. Maslousky

*Attorney, Agent, or Firm*—Martin Smolowitz

[57] ABSTRACT

A hydraulic percussion machine, comprising a body carrying hydraulic passages and valves, and having a gas-filled, hydraulic pressure accumulator for storing the stroke energy which accelerates a piston to strike against a tool. The percussion machine has a separate hydraulic stroke standardizing circuit by action of which the piston stroke is independent of the liquid pressure in the high pressure line supplying the machine and of the volumetric flow.

6 Claims, 1 Drawing Figure

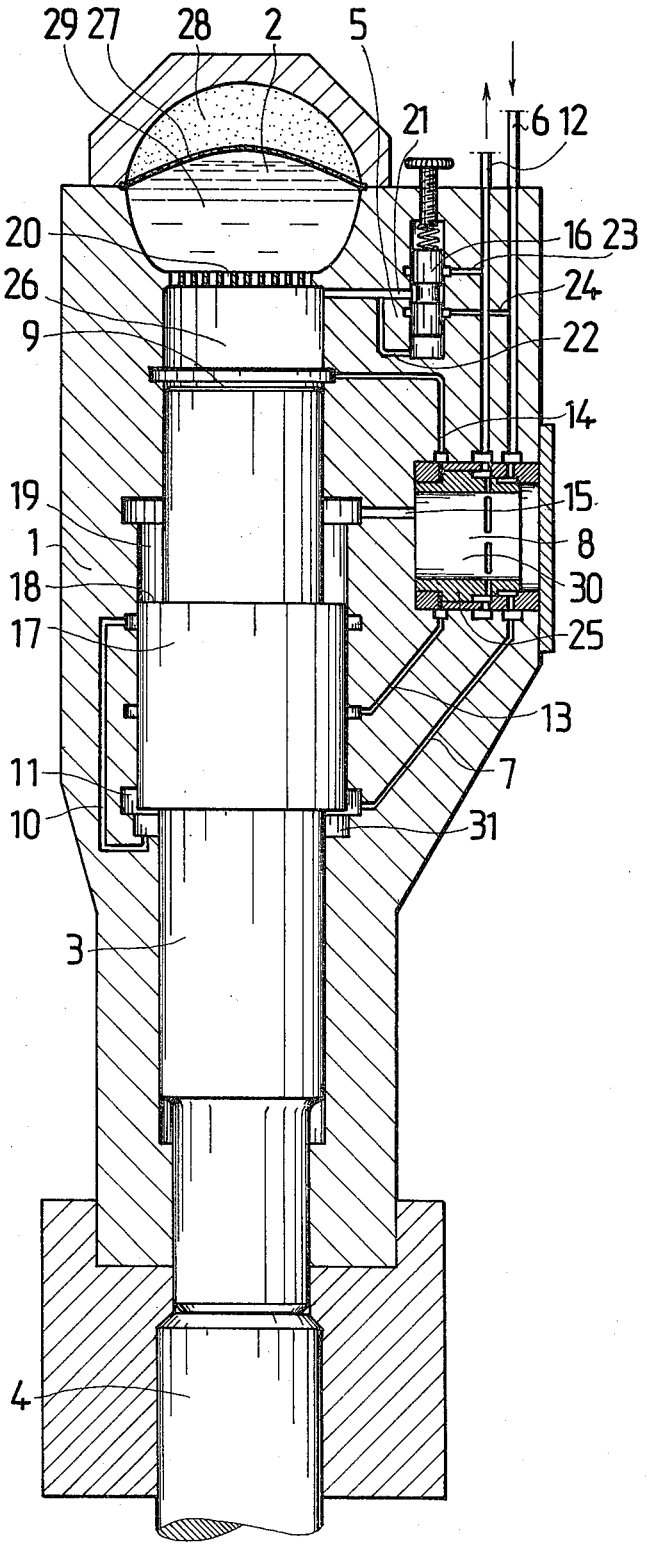
29
27
28
2
5
21
6
12
20
16
23
26
24
9
22
14
19
15
1
8
18
30
17
25
13
11
7
10
31
3
4

HYDRAULIC PERCUSSION MACHINE

BACKGROUND OF INVENTION

The present invention concerns a hydraulic percussion machine comprising a body containing hydraulic passages and valves and said percussion machine having a gas-filled hydraulic pressure accumulator for storing the energy which accelerates the piston to strike against the tool.

In prior art, several percussion machines are known in which the piston hitting the tool is hydraulically reciprocatingly moved and the impact energy is stored in a high pressure accumulator. In the percussion machine of U.S. Pat. No. 3,965,799, the high pressure accumulator communicates directly with the high pressure conduit and is thus connected in parallel with the high pressure volume, the pressure prevailing there lifting the piston upward. The piston is encircled by a distributor means moving in the same direction as the piston and connecting the space above the piston in alternation to the high pressure passage and the return flow passage. Furthermore, there is a relief in the upper part of the piston, serving as control valve and intended to prevent that the striking movement begins before the piston has reached its top position. When the piston has in its top position stopped against the end position damper, with the pressure control valve continuously closed, the pressure begins to rise in the high pressure accumulator until the pressure opens the pressure control valve. The oil is then admitted to flow through the relief in the piston to the distributor means and lifts it into striking position so that from the pressure line and from the high pressure accumulator high pressure oil can flow to the space over the piston, as a consequence whereof the piston commences its stroke.

The detriment with this apparatus is that one has been compelled to provide the passage from the pressure control valve to the distributor means exactly through the relief in the valve. The relief, and the grooves associated therewith in the body itself merely complicate the design. There is furthermore the risk that the pressure control valve will in fact open before the piston has gone into its top position to open for the pressurized oil the path to the distributor means. When such happens, extra energy will be charged into the high pressure accumulator and, after the piston has gone up, this results in an excessively powerful stroke and in overload on the machine. This leads to damage of the machine's structures. If, again, in the design in question the pressure control valve were totally omitted, the range of operation of the machine would be narrowed, which quite obviously is a major detriment. One more drawback of the percussion machine under consideration is that the energy bouncing back from the tool cannot be recovered in any way: it is converted into both heat and mechanical stresses which act on the structures of the machine. Furthermore, as a result of the design, the return line is subjected to high pressure peaks.

In the percussion machine disclosed U.S. Pat. No. 4,034,817, a purely pneumatic pressure accumulator is used for obtaining the stroke energy. The drawback is then the extra pressure tank, which has been disposed separate from the percussion machine itself. Furthermore, in order to connect the tank with the percussion machine one has been compelled to use an extra pneumatic pressure tube. One further detriment which is difficult to eliminate is the sealing problem between the pressure accumulator and the hydraulic volumes. All these drawbacks detract from the reliability in service; they imply more maintenance work, and they increase the complexity of the machine.

SUMMARY OF INVENTION

The object of the present invention is to eliminate the drawbacks mentioned and to provide a reliable and positively operating percussion machine. The percussion machine of the invention is characterized in that the percussion machine comprises a separate hydraulic stroke-standardizing circuit, thanks to which the stroke of the piston is independent of the liquid pressure in the high pressure line supplying the machine and of the volumetric flow. The advantage is then that the stroke is always constant in its magnitude, regardless of the type of basic machine to which the percussion machine has been connected. This carries considerable significance in that the percussion machine will operate exactly as intended, in spite of different basic machines. One obtains by this procedure a reliable percussion machine with a long service life, and also a wider range of operation for the percussion machine is gained.

The percussion machine according to one embodiment of the invention is characterized in that the hydraulic pressure accumulator serving as energy storage has been indirectly connected to the pressure line supplying the machine. The advantage is then that pressure variations taking place in the pressure line do not affect the stroke energy stored in the pressure accumulator; instead the stroke energy is fully constant.

The percussion machine according to another embodiment of the invention is characterized in that the hydraulic pressure accumulator serving as energy storage has been connected to the operating circuit by means of a valve independent of the operating circuit.

The percussion machine of a third embodiment of the invention is characterized in that the main valve is controlled by the piston position. The advantage is then that the stroke length is always the same during the entire operation because the control is a function of position, not of pressure. A higher volumetric flow merely causes faster ascent of the piston, that is the stroke frequency increases, but the stroke length and impact force—or blow—remain constant.

The percussion machine according to one more advantageous embodiment is characterized in that the hydraulic pressure accumulator is always in direct communication with the top face of the piston, whereby the pressure accumulator recovers the kinetic energy of the piston bouncing from the tool. The advantage is then that the bouncing energy is not lost and it does not give rise to thermal or mechanical stresses elsewhere in the construction. An example of mechanical stress may be a pressure peak burdening the body structures or the return line.

The percussion machine according to still another favorable embodiment is characterized in that the piston as it stops at the end of its return motion, releases its kinetic energy into the hydraulic pressure accumulator. The advantage is then that energy is not uselessly dissipated as heat.

The percussion machine according to still another favorable embodiment is characterized in that the machine has, with a view to preventing repeated empty strokes, an inhibitor circuit which connects the pressure volume to the return line if the piston strikes against the end position damper. The advantage is then gained that the mechanical stresses are reduced.

IN THE DRAWINGS

The invention is more closely described in the following with the aid of an embodiment example, referring to the attached drawing, which displays the percussion machine of the invention in a vertical cross-sectional view.

DESCRIPTION OF INVENTION

The percussion machine comprises the following main components: a body frame 1, a gas-filled hydraulic pressure accumulator 2, a piston 3, striking against the tool 4, and a separate hydraulic stroke standardizing circuit 5, which comprises hydraulic passages 21, 22, 23 and 24, and a control pressure valve 16 with valve body and valve adjustment. Moreover, the main components include a hydraulic operating circuit 30, consisting of the high pressure line 6, main valve 8, high pressure passage 7, control pressure passages 13,14 and the passage 15.

The cycle of operation of the percussion machine is as described in the following. From the high pressure line 6, the oil flows through the high pressure passage 7 past the valve 8, in under the bulge part 17 of the piston into the pressure volume 11. The pressurized oil will then push the piston 3 upward, and the piston 3 further with its upper face 9 will push oil into the liquid space 29 of the low pressure accumulator 2. The liquid space 29 and gas space 28 of the low pressure accumulator have been separated by the diaphragm 27. As oil is being pushed into the liquid space 29, the gas is compressed and thereby stores energy. Furthermore, the piston pushes by means of the upper shoulder 18 of its bulge part 17, oil through the passage 15 to the main valve 8, whence the oil passes to the return line 12.

After the piston 3 has risen to its top position, a communication opens through the control pressure passage 13 to the main valve 8, the slide 25 of this valve moving into the striking position. The slide 25 will then direct the high-pressure oil also to the space above the piston's bulge part 17 into the volume 19 by the passage 15, and the return line 12 is closed. The piston, now with differential loading, starts on its blow, whereby the oil coming from the high pressure line 6 flows in over the piston's bulge part 17, by the passage 15. Likewise, from below the piston's bulge part 17 the oil flows along the high pressure passage 7 through the valve 8 into passage 15, and thence further in above the bulge part 17, into the volume 19. However, the piston 3 obtains the major part of its stroke energy from the low pressure accumulator 2, the oil flowing from its liquid space 29 through passages 20 to the volume 26 over the piston, pushing the piston 3 downwardly by action on its top face 9. After the piston has started on its downward way, the control pressure passage 13 closes again, but the slide 25 of valve 8 still remains in the stroke position, until the top face 9 of the piston, nearly at the end of the stroke, opens the second control pressure passage 14, whereby from the valve 8 the oil can flow into the low-pressure volume 26 on top of the piston. The other end of the valve 8 is continuously connected to the high pressure line 6, and hereby it causes the slide 25 to move back. Th operating cycle then begins anew.

The purpose of the control pressure valve 16 is to monitor the pressure in the liquid volume 29 of the low pressure accumulator 2. If at the end of the stroke the pressure in volume 29 falls below the limit that has been set, the control pressure valve 16 will open the passage 24 to the high pressure line 6 and oil will flow from there into the liquid space 29 of the pressure accumulator, increasing its pressure. If, again, the liquid pressure rises too high in the low pressure accumulator 2 as the piston 3 goes up, the control pressure valve 16 will open the passage 23 to the return line 12, thereby lowering the pressure in the liquid space 29 of the low pressure accumulator.

The purpose with the inhibitor circuit 10 is to prevent repeated empty strokes of piston 3, which may be encountered for instance if the tool does not hit the object and strikes into thin air instead. In such case, when the resistance from the object being hit is lacking, the piston will perform a slightly longer stroke than normal and stop against the end position damper 31, with the consequence that the top shoulder 18 of the bulge part 17 of the piston 3 opens the inhibitor circuit 10 to communicate with the volume 19 above the bulge part 17, and the pressurized oil is admitted into this volume. The piston is then arrested in its lowermost position and no repeated empty strokes are possible. When it is desired to release the piston from this locked position, it is enough to press the tool 4 against a stationary object, for instance against a stone, whereby it will lift the piston 3 enough to cause the top shoulder 18 of the bulge part 17 to close off the inhibitor circuit 10. Hereafter the normal operating cycle starts once more.

It is obvios to a person skilled in the art that different embodiments of the invention are not confined merely to the example presented above and that they may vary within the scope of the claims presented hereinbelow.

We claim:

1. An improved hydraulic percussion machine, comprising: a body; a piston within said body; hydraulic passages including a high pressure line and a valve associated with said body to define an hydraulic operating circuit; an hydraulic pressure accumulator disposed in axial alignment with and above said piston; said accumulator having a separate gas-filled chamber and a liquid-filled chamber, said accumulator being in communication with said piston for storing piston stroke energy which accelerates said piston for striking against a tool disposed at the working end of said machine; wherein the improvement comprises: providing said machine with a separate stroke standardizing circuit for maintaining accumulator pressure independent of pressure within said hydraulic operating circuit; said standardizing circuit being provided by pressure monitoring means disposed within hydraulic passages connecting said operational circuit and said accumulator; said monitoring means serving to monitor pressure in said accumulator responsive to piston stroke; and said standardizing circuit being self-regulating during machine operation to permit said piston stroke to be independent of liquid pressure and volumetric flow in said high pressure line supplying said operating circuit.

2. An improved machine according to claim 1, wherein: the hydraulic pressure accumulator is indirectly connected to the high pressure line supplying the operating circuit of said machine.

3. An improved machine according to claim 1, wherein: the hydraulic pressure accumulator is connected to the operating circuit, by valve means independently of the operating circuit, and intermediate said accumulator and operating circuit.

4. An improved machine according to claim 1, wherein: the valve of said operating circuit is controlled by the position of said piston.

5. An improved machine according to claim 1, wherein: the hydraulic pressure accumulator is always in direct connection with a top face of the piston, whereby the pressure accumulator recovers kinetic energy of the piston as it returns to a position back from the tool.

6. An improved machine according to claim 1, wherein: said machine is provided with an inhibitor circuit connecting a pressure volume above a shoulder surface of the piston to a return line when piston travel during operation reaches an end position damper, thereby permitting pressurized liquid to enter within the predefined volume in-line with piston travel and to prevent further piston movement.

* * * * *